US012359356B2

(12) United States Patent
Cornwell et al.

(10) Patent No.: US 12,359,356 B2
(45) Date of Patent: Jul. 15, 2025

(54) YARN WITH SECTIONS HAVING DIFFERENT AESTHETIC CHARACTERISTICS, ARTICLES COMPRISING SAME, AND METHODS OF MAKING SAID YARN AND ARTICLES

(71) Applicant: SHAW INDUSTRIES GROUP, INC., Dalton, GA (US)

(72) Inventors: Tansley Cornwell, Rome, GA (US); Stephen D. Phillips, Rocky Face, GA (US); Christopher S. Bryant, Rocky Face, GA (US)

(73) Assignee: Shaw Industries Group, Inc., Dalton, GA (US)

( * ) Notice: Subject to any disclaimer, the term of this patent is extended or adjusted under 35 U.S.C. 154(b) by 180 days.

(21) Appl. No.: 18/075,771

(22) Filed: Dec. 6, 2022

(65) Prior Publication Data

US 2023/0175184 A1 Jun. 8, 2023

Related U.S. Application Data

(60) Provisional application No. 63/286,323, filed on Dec. 6, 2021.

(51) Int. Cl.
*D05C 15/04* (2006.01)
*D02G 3/22* (2006.01)
(Continued)

(52) U.S. Cl.
CPC ..... *D05C 17/026* (2013.01); *D02G 3/22* (2013.01); *D02G 3/44* (2013.01); *D05C 15/04* (2013.01); *D10B 2401/20* (2013.01)

(58) Field of Classification Search
CPC ..... D05C 17/026; D05C 17/02; D05C 15/04; D05C 15/00; D02G 3/22; D02G 3/44;
(Continued)

(56) References Cited

U.S. PATENT DOCUMENTS 2,600,851 A * 6/1952 Cooper ..... D04B 1/108 66/182
2,876,616 A * 3/1959 Austin, Jr. ..... D01H 5/36 474/135
(Continued)

FOREIGN PATENT DOCUMENTS

DE 102014103978 A1 * 9/2015 ..... D02G 3/12

*Primary Examiner* — Ismael Izaguirre
(74) *Attorney, Agent, or Firm* — Ballard Spahr LLP

(57) ABSTRACT

An article can comprise a backing and a plurality of yarns tufted, knitted, or woven through the backing, each yarn defining at least one aesthetic characteristic. The at least one aesthetic characteristic can comprise luster, color, size, physical attribute associated with material type, or texture. At least one yarn of the plurality of yarns can comprise an engineered yarn structure having a first yarn section and a second yarn section. The engineered yarn structure can comprise a transition junction comprises commingled portions of the first and second yarn sections. The transition junction can have a length of less than 1 millimeter. The first section can have a first type of a first aesthetic characteristic of the at least one aesthetic characteristic, and the second section can have a second type of the first aesthetic characteristic that is different from the first type.

19 Claims, 7 Drawing Sheets
(2 of 7 Drawing Sheet(s) Filed in Color)

(51) Int. Cl.
*D02G 3/44* (2006.01)
*D05C 17/02* (2006.01)

(58) Field of Classification Search
CPC ..... D02G 3/00; D02G 3/445; D02G 3/446; D10B 2401/20
See application file for complete search history.

(56) References Cited

U.S. PATENT DOCUMENTS 3,543,359 A * 12/1970 Ralph ..... D02G 3/346 28/220
4,033,717 A * 7/1977 Whitaker ..... D06P 7/00 28/169
4,993,218 A * 2/1991 Schwartz ..... D02G 3/34 57/208
6,074,751 A * 6/2000 Murakami ..... D02G 3/34 428/397
2003/0064646 A1 * 4/2003 Brown ..... D04B 21/04 428/364

* cited by examiner

YARN WITH SECTIONS HAVING DIFFERENT AESTHETIC CHARACTERISTICS, ARTICLES COMPRISING SAME, AND METHODS OF MAKING SAID YARN AND ARTICLES

CROSS-REFERENCE TO RELATED APPLICATION

This application claims priority to and the benefit of the filing date of U.S. Provisional Patent Application No. 63/286,323, filed Dec. 6, 2021, which is incorporated herein by reference in its entirety.

FIELD

This disclosure is directed to surface covering articles (e.g., tufted, woven, or knitted surface covering articles) comprising yarns (e.g., engineered yarn structures) having sections with different aesthetic characteristics, and systems and methods for making said yarn and said articles. The yarns can be associated with a primary backing. In some examples, the yarns can be tufted through, woven through, or knitted through the primary backing.

BACKGROUND

Yarn can be tufted, woven, or knitted into a backing to form surface covering articles, such as, for example, carpet. In order to prevent noticeable flaws in the article, yarns must either (1) be uniform (to avoid variations from uniformity that lead to undesirable looks such as streaks); or (2) have a particular, consistent pattern (to avoid visible deviations from said pattern that are identifiable as a flaw). Both alternatives are associated with their own costs and lead to waste when uniformity and/or pattern requirements are not met.

Moreover, leftover yarn is typically a waste product having a cost associated with disposal thereof. Accordingly, a use for small batches of leftover yarn is desirable.

Yarns can be dyed along their lengths according to a method called "space dying." However, these space-dyed yarns have long (several centimeter) transitions between dyed sections that can look undesirable in tufted articles. Further, space dying yarn is an expensive process.

SUMMARY

Disclosed herein is an article comprising a backing and a plurality of yarns tufted, woven, or knitted through the backing, each yarn defining at least one aesthetic characteristic. The at least one aesthetic characteristic can comprise one or more of luster, color, size, physical attribute associated with material type, or texture. At least one yarn of the plurality of yarns can comprise an engineered yarn structure comprising a first yarn section and a second yarn section. The engineered yarn structure can comprise a transition junction that comprises commingled portions of the first yarn section and the second yarn section. The transition junction can have a length of less than 1 millimeter. The first yarn section can have a first type of a first aesthetic characteristic of the at least one aesthetic characteristic, and the second yarn section can have a second type of the first aesthetic characteristic that is different from the first type. Optionally, the first and second yarn sections can correspond to respective yarn segments that are joined together via the transition junction.

In one aspect, a method can comprise tufting, weaving, or knitting a plurality of yarns through a backing. Each yarn can define at least one aesthetic characteristic, wherein the at least one aesthetic characteristic comprises one or more of luster, color, size, physical attribute associated with material type, or texture. At least one yarn of the plurality of yarns can comprise an engineered yarn structure comprising a first yarn section and a second yarn section. The engineered yarn structure can comprise a transition junction that comprises commingled portions of the first yarn section and the second yarn section. The transition junction can have a length of less than 1 millimeter. The first yarn section can have a first type of a first aesthetic characteristic of the at least one aesthetic characteristic, and the second yarn section can have a second type of the first aesthetic characteristic that is different from the first type. Optionally, the first and second yarn sections can correspond to respective yarn segments that are joined together via the transition junction.

A method can comprise tufting, weaving, or knitting a plurality of yarns through a backing. A first yarn of the plurality of yarns can comprise an engineered yarn structure comprising a first yarn section and a second yarn section. The engineered yarn structure can comprise a transition junction that comprises commingled portions of the first yarn section and the second yarn section. The transition junction can have a length of less than 1 millimeter. The first yarn section can have a first type of a first aesthetic characteristic selected from luster, color, size, physical attribute associated with material type, or texture. The second yarn section can have a second type of the first aesthetic characteristic that is different from the first type.

In one aspect, a method can comprise forming a yarn comprising an engineered yarn structure comprising a first yarn section and a second yarn section. The engineered yarn structure can comprise a transition junction that comprises commingled portions of the first yarn section and the second yarn section. The transition junction can have a length of less than 1 millimeter. The first yarn section can have a first type of a first aesthetic characteristic of the at least one aesthetic characteristic, and the second yarn section can have a second type of the first aesthetic characteristic that is different from the first type. Optionally, the first and second yarn sections can correspond to respective yarn segments that are joined together via the transition junction.

Additional advantages of the disclosed system and method will be set forth in part in the description which follows, and in part will be understood from the description, or may be learned by practice of the disclosed system and method. The advantages of the disclosed system and method will be realized and attained by means of the elements and combinations particularly pointed out in the appended claims. It is to be understood that both the foregoing general description and the following detailed description are exemplary and explanatory only and are not restrictive of the invention as claimed.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTION

Figure 1:
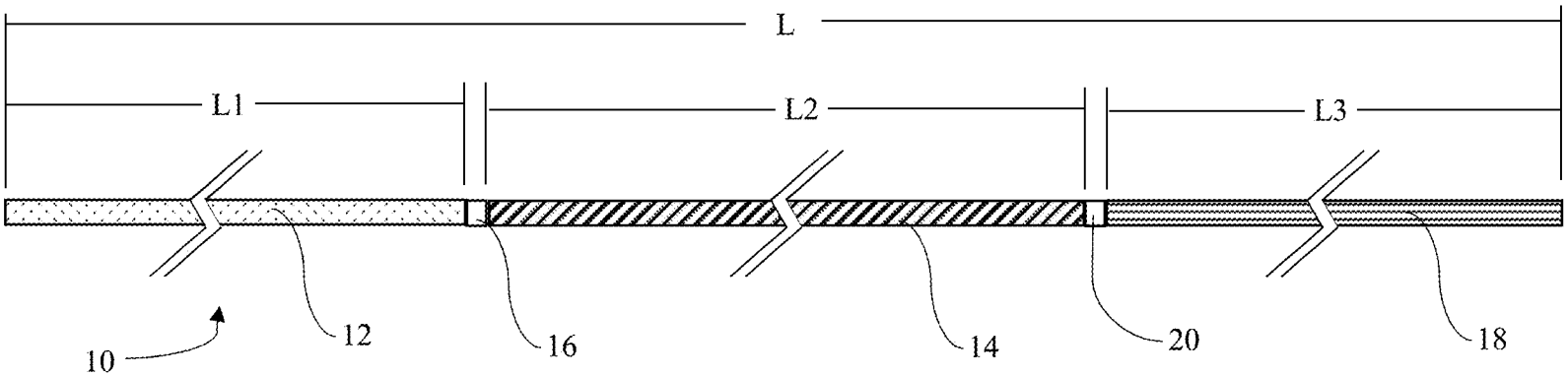
FIG. 1 is a schematic diagram of a yarn having a plurality of sections having differing aesthetic characteristics.

The disclosed articles, systems and methods may be understood more readily by reference to the following detailed description of particular embodiments and the examples included therein and to the Figures and their previous and following description.

It is to be understood that the terminology used herein is for the purpose of describing particular embodiments only and is not intended to limit the scope of the present disclosure which will be limited only by the appended claims.

It must be noted that as used herein and in the appended claims, the singular forms "a," "an," and "the" include plural references unless the context clearly dictates otherwise. Thus, for example, reference to "a section" includes one or more of such sections, and so forth.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Optionally, in some aspects, when values are approximated by use of the antecedents "about," "substantially," or "generally," it is contemplated that values within up to 15%, up to 10%, up to 5%, or up to 1% (above or below) of the particularly stated value or characteristic can be included within the scope of those aspects.

Unless defined otherwise, all technical and scientific terms used herein have the same meanings as commonly understood by one of skill in the art to which the disclosed apparatus, system, and method belong. Although any apparatus, systems, and methods and materials similar or equivalent to those described herein can be used in the practice or testing of the present apparatus, system, and method, the particularly useful methods, devices, systems, and materials are as described.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification. Thus, words denoting order, such as "first" or "next," should be interpreted as optional aspects unless plain meaning or logic dictates otherwise.

The term "yarn" as used herein refers to a continuous strand or bundle of fibers. Such yarns can include, for example and without limitation, monofilament yarns, cut yarns, looped yarns, fibrillated yarns, multifilament yarns, twisted yarns, wrapped yarns, staple yarns, and the like. Optionally, yarns can be textured using conventional methods. "Yarns" as disclosed herein are capable of being independently delivered to a backing structure (for example, via tufting). A yarn can be a single end yarn (single ply yarn) or a multiple end yarn (e.g., a plied yarn) that includes plurality of single end yarns that are entangled or otherwise commingled with one another (for example, by air entanglement, twisting, wrapping, and the like) such that the single end yarns are no longer individually or independently moveable. For example, a plurality of single end yarns can be twisted together to form a plied yarn (e.g., a two-ply yarn can include two single end yarns that are twisted together). Each single end yarn can be formed from at least one filament (optionally, a plurality of filaments). Thus, within a multiple end yarn, each single end yarn that makes up the multiple end yarn can include a respective filament or plurality of filaments.

Yarn with Different Aesthetic Characteristics Along Yarn Length

Disclosed herein with reference to FIG. 1 is a yarn 10 having an engineered yarn structure comprising a first yarn section 12 and a second yarn section 14, with a transition junction 16 comprising commingled portions of the first yarn section and the second yarn section. The yarn 10 can further comprise a third yarn section 18. A transition junction 20 can comprise commingled portions of the second yarn section and the third yarn section. As used herein, the term "commingled" refers to a structural arrangement in which respective components are mingled or amalgamated together. The yarn 10 can comprise any number of yarn sections (e.g., 2-20 sections or 3-10 sections) with a respective transition junction at least partially formed by commingled portions of sequential and/or adjacent yarn sections. Optionally, at least one of (optionally, each of) the transition junctions (e.g., the transition junction 16 and/or the transition junction 20) can have a length of less than ten millimeters, less than four millimeters, less than 2 millimeters, or less than one millimeter. As further described herein, each yarn section of yarn 10 can correspond to a respective yarn segment, which can optionally be embodied as a discarded or leftover portion of yarn or a non-compliant (off-specification) portion of yarn. More generally, it is contemplated that each yarn segment (that forms a respective yarn section) can correspond to a discrete length of yarn that is joined with other discrete lengths of yarn (other yarn segments) to form a yarn structure as disclosed herein.

The yarn 10 can define one or more aesthetic characteristics. The one or more aesthetic characteristics can comprise one or more of a color, a luster, a size (e.g., a diameter and/or a number of fibers), a physical attribute associated with material type, or a texture. In further aspects, the at least one aesthetic characteristic can be a function of a polymer type(s) and/or a shrinkage rate. Each yarn section (e.g., the first, second, and third sections 12, 14, 18) can have a respective type of each aesthetic characteristic associated therewith. For example, the first yarn section 12 can have a first type of a first aesthetic characteristic, and the second yarn section 14 can have a second type of the first aesthetic characteristic. The third yarn section 18 can have a third type of the first aesthetic characteristic. In one example, the first aesthetic characteristic is a color. Thus, the first yarn section 12 can have a first color, and the second yarn section 14 can have a second color. In another example, the first aesthetic characteristic can be a luster. In this example, the first yarn section 12 can have a first luster, and the second yarn section 14 can have a second luster. In some examples, each yarn section can define a first aesthetic characteristic and a second aesthetic characteristic. In some aspects, the first and second yarn sections 12, 14 can have different types of the first aesthetic characteristic. In further aspects, the first and second yarn sections can further have the same or different types of the second aesthetic characteristic.

Each yarn section can comprise a plurality of fibers. The transition junction 16 can be formed by splicing (e.g., air splicing) the first yarn section to the second yarn section. Although air splicing is one specific method for joining (and commingling) the yarn sections, it is contemplated that any conventional splicing or yarn joining method can be employed. In addition to, or as an alternative to air splicing, it is contemplated that the transition junctions can be formed by wrap splicing, mechanical knotting, twisting, entanglement (e.g., air entanglement), or combinations thereof. Accordingly, the transition junction 16 can comprise fibers of the first yarn section 12 commingled with fibers of the second yarn section 14. Thus, the transition junction 16 can comprise aesthetic characteristics associated with each of the first yarn section and the second yarn section. Thus, unlike conventional yarn splicing, wherein yarns of the same aesthetic characteristics are joined, the adjacent yarn sections can have different aesthetic characteristics, with the different aesthetic characteristics mixed within each transition junction.

Optionally, the yarn 10 can comprise sequential yarn sections that are joined at respective transition junctions and that alternate between the first and second type of the first aesthetic characteristic. Thus, the first and third yarn sections 12, 18 can share the same type of first aesthetic characteristic, with the second yarn section 14 being different from the first and third sections. Optionally, the first and third yarn sections 12, 18 can be identical in terms of aesthetic characteristics. In further aspects, the first aesthetic characteristic of the third yarn section can be a third type that is different from the respective first aesthetic characteristics of the first and second yarn sections 12, 14.

In some aspects, each section (e.g., the first, second, and third yarn sections 12, 14, 18) can have the same length. In further aspects, each yarn section can have a different length. In yet further aspects, some yarn sections can have the same length, and other yarn sections can have a different length. For example, the first yarn section 12 can have a first length L1, the second yarn section 14 can have a second length L2, and the third yarn section 18 can have a third length L3. Optionally, the first length L1 can be different from the second length L2. It is contemplated that the length of each yarn section can be randomly generated or selected during formation of the yarn 10 as further disclosed herein. Thus, each of the first length L1 and the second length L2 can be randomly generated. In various optional aspects, the length of each segment can be from about 800 meters to about 5000 meters, or from about 1000 meters to about 3000 meters.

In some optional aspects, the first aesthetic characteristic can be uniform along each yarn section. In other aspects, the first aesthetic characteristic can vary along at least one yarn section of the yarn. In some optional aspects, the first aesthetic characteristic can be uniform through a cross section of the yarn, which can contrast to, for example, yarn that has aesthetic characteristics imparted through dying of the yarn.

Figure 2:
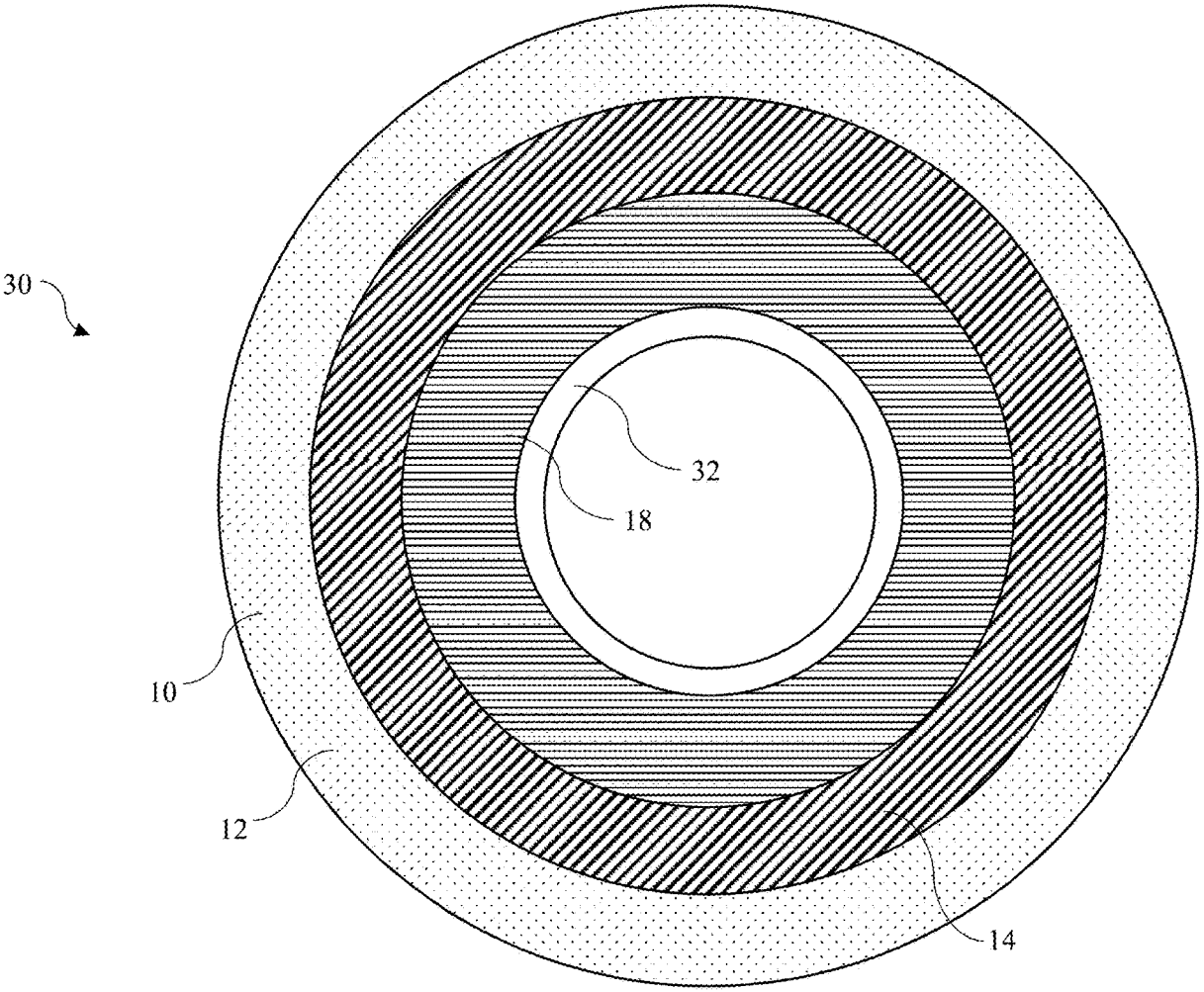
FIG. 2 is a schematic diagram of a yarn package comprising the yarn of FIG. 1.
Figure 3:
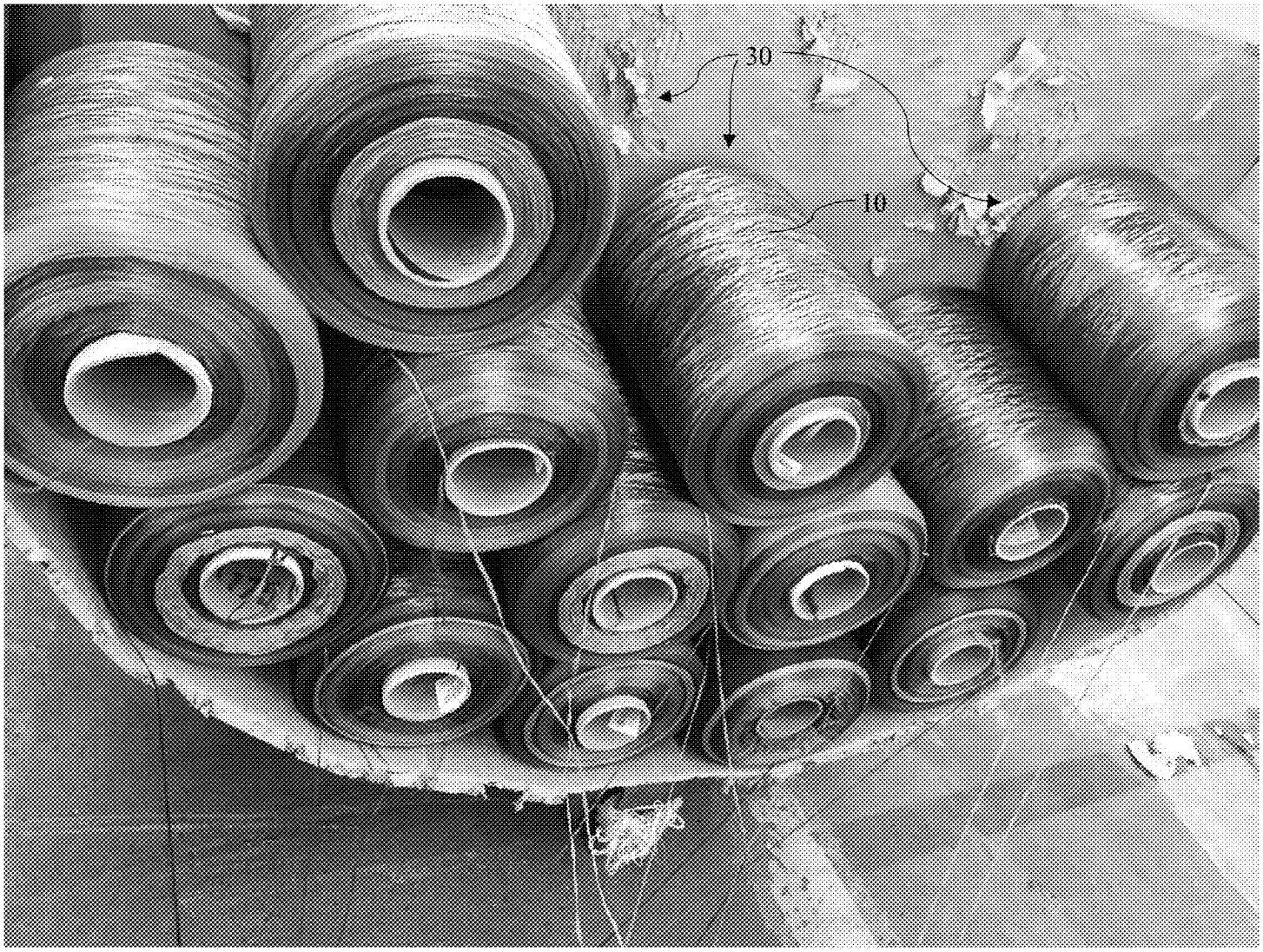
FIG. 3 is a perspective view of a plurality of yarn packages as disclosed herein.

Referring also to FIG. 2, the yarn 10 can be formed into a yarn package 30 comprising a bobbin 32 (or tube) with the yarn wound therearound.

Figure 4:
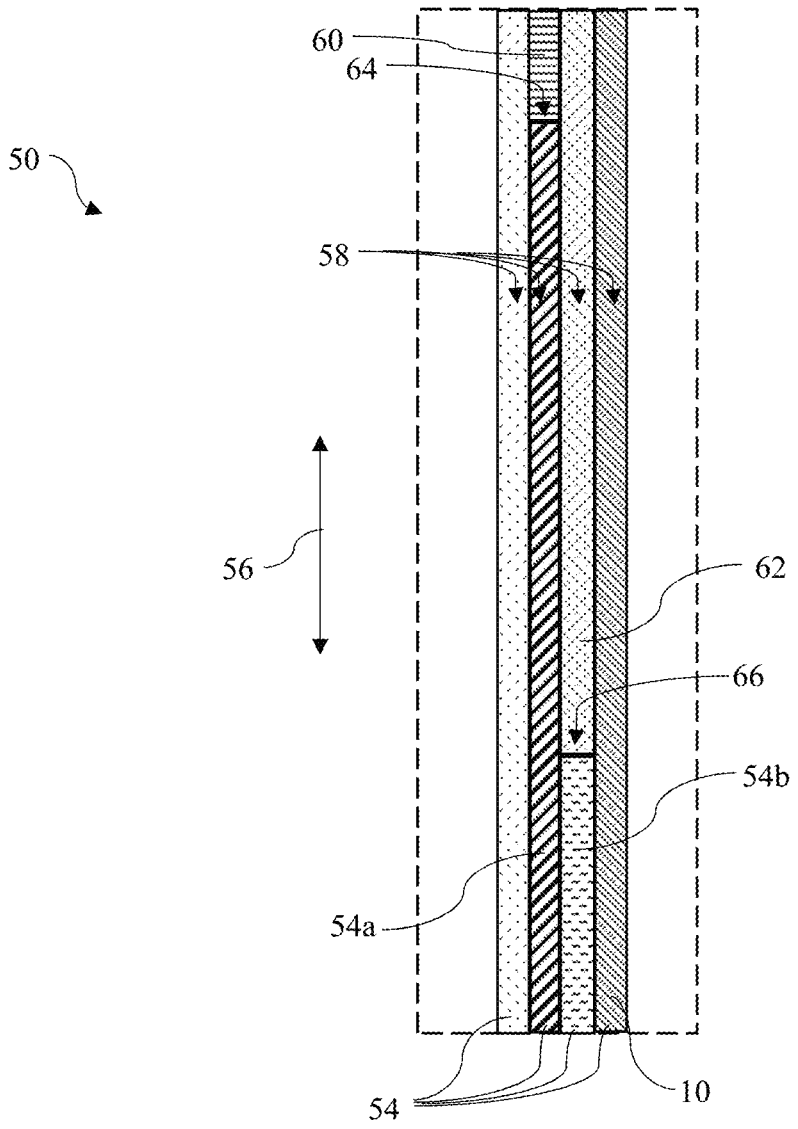
FIG. 4 is a schematic diagram of a portion of an article comprising a yarn having a plurality of sections having differing aesthetic characteristics as disclosed herein.
Figure 5:
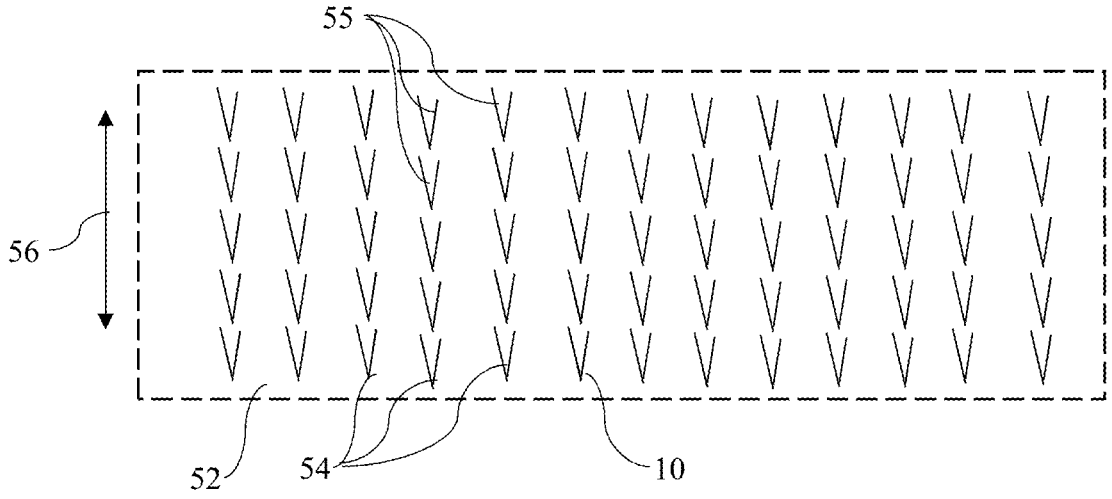
FIG. 5 is a schematic diagram of a portion of an article comprising a yarn having a plurality of sections having differing aesthetic characteristics as disclosed herein.

Article Comprising Yarn with Different Aesthetic Characteristics Along Yarn Length Referring also to FIGS. 4-5, an article 50 can comprise a backing 52 (e.g., a primary backing) and a plurality of yarns 54 tufted, woven, or knitted therethrough. At least one yarn of the plurality yarns 54 can be in accordance with the yarn 10 as disclosed herein. Accordingly, at least one yarn of the plurality of yarns 54 can be a yarn 10 comprising an engineered yarn structure having a first yarn section 12 and a second yarn section14. The engineered yarn structure can comprise a transition junction 16 comprising commingled portions of the first yarn section 12 and the second yarn section 14. The transition junction can have a length of less than ten millimeters, less than four millimeters, less than two millimeters, or less than one millimeter.

Optionally, yarn(s) 10 of the plurality of yarns 54 can further comprise a third yarn section 18 and a transition junction 20 that comprises commingled portions of the second and third yarn sections 14, 18. The yarn 10 can comprise any number of yarn sections (e.g., 2-20 sections or 3-10 sections). The transition junction 20 can have a length of less than ten millimeters, less than four millimeters, less than 2 millimeters, or less than one millimeter.

Each yarn section (e.g., the first, second, and third yarn sections 12, 14, 18) of the yarn(s) 10 of the plurality of yarns 54 can define at least one aesthetic characteristic. The at least one aesthetic characteristic can comprise one or more of a color, a luster, a size (e.g., a diameter or a number of fibers), or a texture. Each yarn section can have a respective type of each aesthetic characteristic associated therewith. For example, the first yarn section 12 can have a first type of a first aesthetic characteristic, and the second yarn section 14 can have a second type of the first aesthetic characteristic. When provided, the third yarn section 18 can have a third type of the first aesthetic characteristic. In one example, the first aesthetic characteristic is a color. Thus, the first yarn section 12 can have a first color, and the second yarn section can have a second color. In another example, the first aesthetic characteristic can be a luster. The first yarn section 12 can have a first luster, and the second yarn section can have a second luster. In some examples, each yarn section can define a first aesthetic characteristic and a second aesthetic characteristic. The first and second yarn sections 12, 14 can have different types of the first aesthetic characteristic. The first and second yarn sections 12, 14 can further have the same or different types of the second aesthetic characteristic. Optionally, yarn sections can differ in combinations of one or several aesthetic characteristics (e.g., color, luster, size, texture, polymer, or shrinkage). Optionally, the yarn sections can differ due to different material properties. For example, each yarn section can comprise, or consist of, or consist essentially of nylon 6, nylon 66, polyethylene terephthalate (PET), polypropylene, wool, or a combination thereof. Yarns made of different materials can have different aesthetic characteristics. Each yarn section can comprise any number of yarn plies (e.g., the number of yarn plies can be the same as or different from adjacent sections or other sections of the same yarn).

Optionally, the at least one yarn 10 of the plurality of yarns 54 can comprise sequential yarn sections that are joined at respective transition junctions and that alternate between the first and second type of the first aesthetic characteristic. Thus, for example, the first and third yarn sections 12, 18 of the at least one yarn 10 can share the same type of first aesthetic characteristic (e.g., a first type of the first aesthetic characteristic), with the first aesthetic characteristic of the second section 14 (e.g., a second type of the first aesthetic characteristic) being different from the first aesthetic characteristic of the first and third yarn sections 12, 18. Optionally, the first and third yarn sections 12, 18 can be identical in terms of aesthetic characteristics. In further aspects, the first aesthetic characteristic of the third yarn section 18 can be a third type that is different from the respective first aesthetic characteristics of the first and second yarn sections 12, 14.

Optionally, some (e.g., at least 20%, between 20% and 80%, or up to 80%) of the yarns or all the yarns of the article 50 can be in accordance with the yarn 10 as disclosed herein. Each respective yarn 54 can be tufted into a respective row using conventional tufting methods. Each yarn 54 can form tufts 55 in respective rows 58 that extend along a tufting axis 56. The article 50 can have a tufting axis 56 along which each row 58 extends. Similarly, in further aspects, each yarn 54 can be woven or knitted into respective rows using conventional weaving or knitting methods.

A yarn 10 can form a plurality of tufts 55 within a single row 58. The yarn 10 can be tufted by a single needle (e.g., a single needle of a needle bar) to form the plurality of tufts 55 within the single row 58. The tufts 55 of the single row 58 can comprise tufts formed from the first yarn section 12 and the second yarn section 14. In some aspects, a portion of the tufts 55 within a row 58 can consist of the first yarn section and a portion of the tufts of the row can consist of the second yarn section. The transition junction 16 can be disposed within the single row 58 and can be positioned at a location (e.g., within a tuft) between tufts 55 formed entirely from the first yarn section 12 and tufts formed entirely from the second yarn section 14. Optionally, in some aspects, the yarn 10 can further comprise a third yarn section and a second transition junction 20 formed by commingled portions of the second and third yarn sections. In these aspects, it is contemplated that a portion of the tufts 55 within the row 58 can consist of the third yarn section, with the second transition junction disposed within the row 58 and positioned at a location (e.g., within a tuft) between tufts formed entirely from the second yarn section and tufts formed entirely from the third yarn section. In exemplary aspects, the tufts 55 within each row 58 can be loop or cut pile or combinations of loop and cut pile.

In some aspects, the article 50 can have at least a first yarn 54*a* and a second yarn 54*b*, each having a structure in accordance with yarn 10. A first yarn section 60 of the first yarn 54*a* and a first yarn section 62 of the second yarn 54*b* can each have a respective starting location 64, 66 along the tufting axis 56 at which the respective sections begin. Optionally, the starting location 64 of the first yarn section 60 of the first yarn 54*a* can be axially offset from the starting location 66 of the first yarn section 62 of the second yarn 54*b* along the tufting axis 56. Alternatively, the starting locations 64, 66 can be in alignment or even or substantially even along the tufting axis 56.

In some aspects, each yarn section (e.g., the first, second, and third yarn sections 12, 14, 18) of one or more yarns of the plurality of yarns 54 can have the same length. In further aspects, each yarn section of one or more yarns of the plurality of yarns 54 can have a different length. In yet further aspects, some yarn sections of one or more yarns of the plurality of yarns 54 can have the same length, and other yarn sections of the same yarns can have a different length. For example, and with reference to FIG. 1, for at least one yarn of the plurality of yarns 54, the first yarn section 12 can have a first length L1, the second yarn section 14 can have a second length L2, and the third yarn section 18 can have a third length L3. Optionally, the first length L1 can be different from the second length L2. It is contemplated that the length of each yarn section can be randomly generated during formation of the yarns. Thus, each of the first length L1 and the second length L2 can be randomly generated. In various optional aspects, the length of each yarn can be from about 800 meters to about 5000 meters, or from about 1000 meters to about 3000 meters.

Optionally, adjacent (side-by-side or parallel) yarn sections of adjacent yarns can have different lengths. For example, the first and second yarns 54*a,b* can be adjacent each other. As shown, the first yarn 54*a* can have a first yarn section 60, and the second yarn 54*b* can have a second yarn section 62, wherein the first yarn section 60 and first yarn section 62 are adjacent. The first yarn sections 60 and 62 can optionally have different lengths. This can advantageously prevent patterns forming in the tufted, woven, or knitted article.

Method of Making Article Comprising Yarn with Different Aesthetic Characteristics Along Yarn Length Referring to FIGS. 2-5, a method can comprise tufting, weaving, or knitting the plurality of yarns 54 through a backing 52, wherein each yarn defines an aesthetic characteristic or a plurality of aesthetic characteristics. One or more yarns of the plurality of yarns can be embodied as yarn 10 as disclosed herein. Thus, the one or more yarns can each comprise an engineered yarn structure having a first yarn section 12 and a second yarn section 14. The engineered yarn structure can comprise a transition junction 16 having commingled portions of the first and second yarn sections, wherein the transition junction has a length of less than ten millimeters, less than four millimeters, less than two millimeters, or less than one millimeter. Optionally, some (e.g., at least 20%, between 20% and 80%, or up to 80%) of the yarns or all the yarns 54 can be in accordance with the yarn 10 as disclosed herein.

The method can comprise drawing the plurality of yarns from respective yarn packages 30, wherein at least one yarn package of the respective yarn packages comprises a plurality of sections, wherein each section of the plurality of sections differs from adjacent sections by the aesthetic characteristic. The yarn packages can, for example, be positioned on a creel that feeds the yarn of the yarn packages into a textile machine (e.g., a tufting machine, a weaving machine, or a knitting machine). In exemplary aspects, it is contemplated that each section of the plurality of sections of a yarn package 30 can correspond to a respective yarn section in a yarn 54.

Referring to FIGS. 2-5, the backing 52 can be moved along the tufting axis 46, and the plurality of yarns 54 can be tufted through the backing to form a plurality of rows that extend along the tufting axis. Optionally, the plurality of yarns can be tufted so that respective yarn sections of two yarns (e.g., adjacent yarn sections 60, 62 of the first and second yarns 54*a,b*) can have respective starting locations 64, 66 along the tufting axis 46, with the starting location of the first section of the first yarn in a location that is axially offset from the starting location 60 of the first section of the second yarn along the tufting axis 46. Although it should be understood that knitting and weaving have respective knitting and weaving axes, for conciseness, these axes are referred to herein generally as tufting axes.

System and Method of Making Yarn with Different Aesthetic Characteristics Along Yarn Length A method can comprise forming a yarn 10 comprising an engineered yarn structure having a first yarn section 12 and a second yarn section 14. The engineered yarn structure can comprise a transition junction 16 that comprises commingled portions of the first and second yarn sections. The transition junction can have a length of less than 4 millimeters, less than 2 millimeters, or less than 1 millimeter. The first yarn section 12 can have a first type of a first aesthetic characteristic, and the second yarn section 14 can have a second type of the first aesthetic characteristic that is different from the first type. Forming the yarn 10 can comprise splicing or otherwise securely coupling a first yarn segment with a second yarn segment (e.g., via a transition junction), wherein the first yarn segment has the first type of the first aesthetic characteristic, and wherein the second yarn segment has the second type of the first aesthetic characteristic. As further described herein, the first and second yarn sections can correspond to respective yarn segments that are joined together to produce a unitary yarn structure. Optionally, the first and second yarn segments can be leftover yarns (or portions of yarns) or yarn that is off specification from an intended specification. Thus, instead of disposing of leftover or off-specification yarns as waste, the first and second yarn segments can be formed into yarn 10.

In some optional aspects, an apparatus 100 can be configured to form the yarn 10. The apparatus 100 can assemble a plurality of yarns to form the yarn 10. The apparatus 100 can receive yarn from a yarn supply 102 comprising a plurality of yarns 104. The type of each aesthetic characteristic of each yarn 104 can optionally be uniform along its length. Each yarn 104 can optionally be leftover yarn or yarn that is off specification from an intended specification. The apparatus 100 can comprise an assembler 106 (e.g., an air splicer or a heat splicer) that is configured to selectively assemble yarns 104 from the yarn supply 102 to form a yarn 10. The apparatus 100 can optionally be in communication with a winder 108 that is configured to wind yarn from the apparatus 100 into a yarn package 30.

The apparatus 100 can be in communication with a controller 110 that determines which yarn 104 the apparatus draws from. Thus, the controller can determine, based on the yarns 104 in the yarn supply 102, the aesthetic characteristics of each segment of the yarn 10 by determining the yarn 104 from which the apparatus 100 is drawing. The controller 110 can further determine the length of each segment formed by the apparatus. Optionally, the controller 110 can be integral to the apparatus 100. In further aspects, the controller 110 can be separate from and in communication with the apparatus 100.

In some aspects, the controller 110 can use a randomization algorithm to randomly select between yarns 104 of the yarn supply 102, thereby causing the first section of at least one yarn of the at least one yarn to have a random type of aesthetic characteristic. In further aspects, the controller 110 can randomly generate a length of the yarn 104 to be formed into a segment of yarn 10. For example, a randomized time can be generated, and the apparatus 100 can draw yarn from a given yarn 104 for the randomized time.

It is contemplated that randomization of the aesthetic characteristic(s) of each yarn segment and/or length can be particularly advantageous in avoiding undesirable features in a tufted, woven, or knitted article. For example, it can be understood that if all lengths of segments of yarn are identical, patterns repeat along the article (along the tufting axis 56 in which each yarn forms tufts). Similarly, if ends of adjacent yarns are aligned and segments of adjacent yarns have the same length, thick lines that are perpendicular to the tufting axis 56 in which each yarn forms tufts would appear. That is, tufts formed from different-looking yarns next to each other appear to blend together to provide the appearance of a color gradient, whereas multiple yarns of the same aesthetic characteristic(s) across the tufted article transverse to the tufting axis 56 form a noticeable elongate portion that stands out and does not blend with the rest of the tufted article, and can be perceived as undesirable. Similarly, randomization of the aesthetic characteristic(s) can avoid unintentional streaks formed by adjacent yarns having the same aesthetic characteristic(s). Randomization of the aesthetic characteristic(s) can further avoid a need for an operator to order yarn packages in a particular order on a creel that feeds a tufting apparatus.

Advantages of Articles, Systems, and Methods Disclosed Herein

Figure 6:
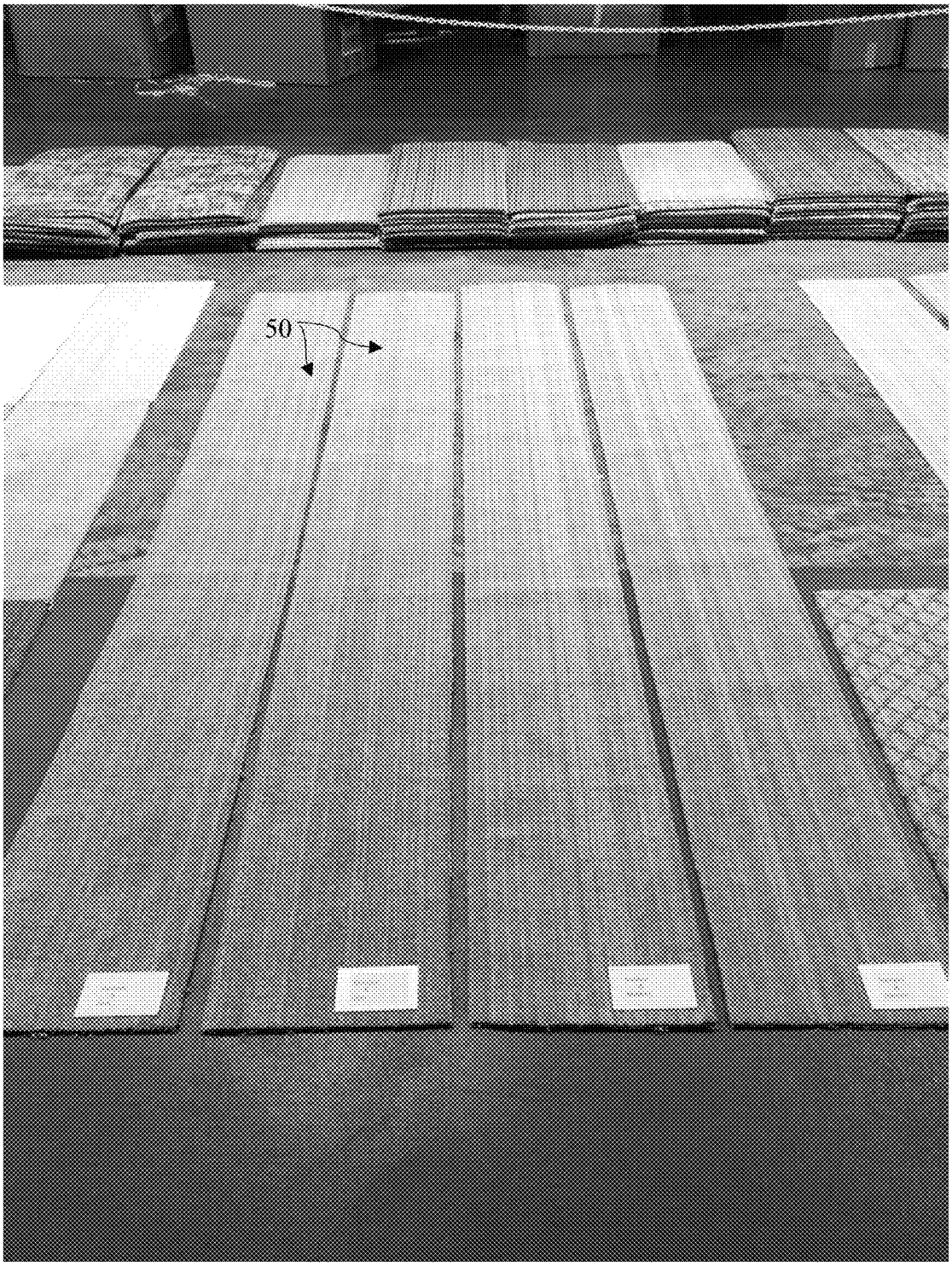
FIG. 6 is a perspective view of a plurality of tufted articles as disclosed herein.
Figure 7:
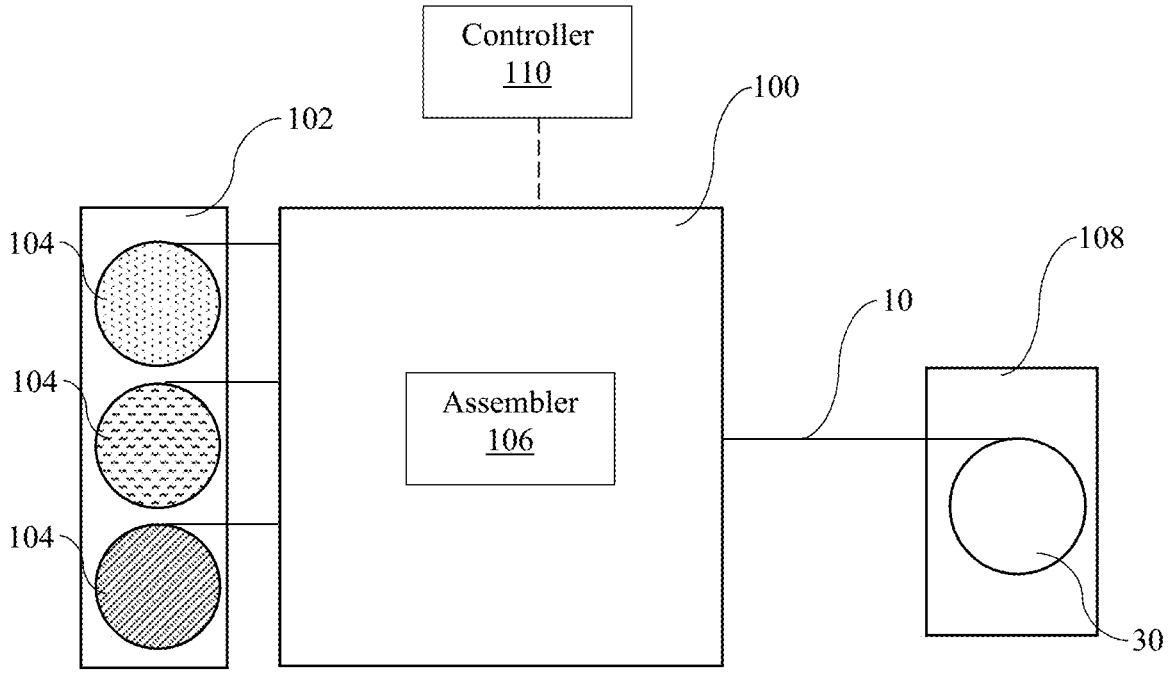
FIG. 7 is a schematic diagram of a system for forming yarn as disclosed herein.

It can be understood that the disclosed systems and methods can form tufted, woven, or knitted articles having desirable aesthetic patterns. For example, as shown in FIG. 6, the articles can have random or seemingly random patterns. In exemplary aspects, the random or seemingly random patterns can result from the selection and joining of sections of available leftover or off-specification yarn, which can provide an unpredictable and/or random combination of aesthetic properties and sizes. Further, the disclosed articles do not undesirably form long runs from inadvertent alignment of multiple yarns of identical aesthetic characteristic types (e.g., the same color) as can be the case in other patterns where operators are required to introduce randomness. Moreover, as further described herein, the disclosed systems and methods enable use of leftover or off-specification yarn, thereby reducing waste.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: An article comprising:

a backing; and a plurality of yarns tufted, woven, or knitted through the backing, each yarn defining at least one aesthetic characteristic, wherein the at least one aesthetic characteristic comprises one or more of luster, color, size, physical attribute associated with material type, or texture, wherein at least one yarn of the plurality of yarns comprises an engineered yarn structure having:

a first yarn section; and a second yarn section, wherein the engineered yarn structure comprises a transition junction that comprises commingled portions of the first yarn section and the second yarn section, wherein the transition junction has a length of less than 1 millimeter and, wherein the first section has a first type of a first aesthetic characteristic of the at least one aesthetic characteristic, and wherein the second section has a second type of the first aesthetic characteristic that is different from the first type.

Aspect 2: The article of aspect 1, wherein the first aesthetic characteristic is color, wherein the first type is a first color, and wherein the second type is a second color.

Aspect 3: The article of aspect 1, wherein the first aesthetic characteristic is luster, wherein the first type is a first luster, and wherein the second type is a second luster.

Aspect 4: The article of any one of the preceding aspects, wherein the first aesthetic characteristic is uniform along each of the first yarn section and the second yarn section.

Aspect 5: The article of any one of the preceding aspects, wherein the first yarn section of a first yarn of the at least one yarn of the plurality of yarns has a first length, wherein the first yarn section of a second yarn of the at least one yarn of the plurality of yarns has a second length that is different from the first length.

Aspect 6: The article of aspect 5, wherein the article has a first axis along which rows of tufts of the first and second yarns extend, wherein the first section of each of the first and second yarns has a respective starting location along the first axis, and wherein the starting location of the first section of the first yarn is axially offset from the starting location of the first section of the second yarn along the first axis.

Aspect 7: The article of any one of the preceding aspects, wherein a first yarn of the at least one yarn of the plurality of yarns comprises a third yarn section, wherein the engineered yarn structure comprises a second transition junction that comprises commingled portions of the second yarn section and the third yarn section, wherein the first and third yarn sections of the first yarn both have the first type of the first aesthetic characteristic.

Aspect 8: The article of any one of the preceding aspects, wherein at least a first yarn of the at least one yarn of the plurality of yarns comprises sequential yarn sections that are joined at respective transition junctions and that alternate between the first and second type of the first aesthetic characteristic.

Aspect 9: The article of any one of aspects 1-6, wherein at least a first yarn of the at least one yarn of the plurality of yarns comprises a third yarn section, wherein the engineered yarn structure comprises a second transition junction that comprises commingled portions of the second yarn section and the third yarn section, wherein the first aesthetic characteristic of the third yarn section is a third type that is different from the first and second types.

Aspect 10: The article of any one of the preceding aspects, wherein each of the first yarn section and the second yarn section of each yarn of the at least one yarn of the plurality of yarns has a respective length that is randomly generated during formation of the yarns.

Aspect 11: The article of any one of the preceding aspects, wherein the first and second yarn sections of each yarn of the at least one yarn of the plurality of yarns have respective lengths of between 800 meters and 5000 meters.

Aspect 12: The article of aspect 11, wherein the first and second yarn sections of each yarn of the at least one yarn of the plurality of yarns have respective lengths between 1000 meters and 3000 meters.

Aspect 13: The article of any one of the preceding aspects, wherein each yarn of the plurality of yarns comprises an engineered yarn structure having:

a first yarn section; and a second yarn section, wherein the engineered yarn structure comprises a transition junction that comprises commingled portions of the first yarn section and the second yarn section, wherein the transition junction has a length of less than 1 millimeter.

Aspect 14: A method comprising:

tufting, knitting, or weaving a plurality of yarns through a backing, wherein a first yarn of the plurality of yarns comprises an engineered yarn structure having:

a first yarn section; and a second yarn section, wherein the engineered yarn structure comprises a transition junction that comprises commingled portions of the first yarn section and the second yarn section, wherein the transition junction has a length of less than 1 millimeter, wherein the first yarn section has a first type of a first aesthetic characteristic selected from luster, color, size, or texture, and wherein the second yarn section has a second type of the first aesthetic characteristic that is different from the first type.

Aspect 15: The method of aspect 14, further comprising drawing the plurality of yarns from respective yarn packages, wherein a first yarn package of the respective yarn packages comprises at least first and second sections, wherein each of the first and second sections of the first yarn package corresponds to a respective one of the first and second yarn sections of the first yarn.

Aspect 16: The method of aspect 14 or aspect 15, further comprising forming the plurality of yarns.

Aspect 17: The method of aspect 16, wherein forming the plurality of yarns comprises splicing a first yarn segment with a second yarn segment to form the yarn structure of the first yarn, wherein the first yarn segment has the first type of the first aesthetic characteristic, and wherein the second yarn segment has the second type of the first aesthetic characteristic.

Aspect 18: The method of aspect 17, wherein the first and second yarn segments are leftover yarns.

Aspect 19: The method of aspect 17, wherein forming the yarns comprises air splicing the first yarn segment to the second yarn segment to form the transition junction therebetween.

Aspect 20: The method of aspect 19, wherein forming the yarns comprises using a controller to apply a randomization algorithm to cause the first yarn section of the first yarn to have a random length.

Aspect 21: The method of aspect 19, wherein forming the yarns comprises using a controller to apply a randomization algorithm to cause the first yarn section of the first yarn to have a random type of aesthetic characteristic.

Aspect 22: The method of any one of aspects 14-21, wherein the first aesthetic characteristic is color, wherein the first type is a first color, and wherein the second type is a second color.

Aspect 23: The method of any one of aspects 14-21, wherein the first aesthetic characteristic is luster, wherein the first type is a first luster, and wherein the second type is a second luster.

Aspect 24: The method of any one of aspects 14-23, wherein the first aesthetic characteristic is uniform along each of the first section and the second section.

Aspect 25: The method of any one of aspects 14-24, wherein a second yarn of the plurality of yarns comprises an engineered yarn structure having:

a first yarn section; and a second yarn section, wherein the engineered yarn structure comprises a transition junction that comprises commingled portions of the first yarn section and the second yarn section, wherein the first yarn section of the first yarn of the at least one yarn of the plurality of yarns has a first length, and wherein the first yarn section of the second yarn has a second length that is different from the first length.

Aspect 26: The method of any one of aspects 14-25, wherein a second yarn of the plurality of yarns comprises an engineered yarn structure having:

a first yarn section; and a second yarn section, wherein the engineered yarn structure comprises a transition junction that comprises commingled portions of the first yarn section and the second yarn section, wherein tufting, knitting, or weaving the plurality of yarns through the backing comprises moving the backing along a first axis and tufting the plurality of yarns through the backing to form a plurality of rows that extend along the first axis, wherein the first yarn section of each of the first and second yarns has a respective starting location along the first axis, and wherein tufting, knitting, or weaving the plurality of yarns through the backing comprises tufting, knitting, or weaving the starting location of the first yarn section of the first yarn in a location that is axially offset from the starting location of the first yarn section of the second yarn along the first axis.

Aspect 27: The method of any one of aspects 14-26, wherein the first yarn of the plurality of yarns comprises a third yarn section, wherein the engineered yarn structure comprises a second transition junction that comprises commingled portions of the second yarn section and the third yarn section, wherein the first and third yarn sections of the first yarn both have the first type of the first aesthetic characteristic.

Aspect 28: The method of any one of aspects 14-27, wherein at least the first yarn of the plurality of yarns comprises sequential yarn sections that are joined at respective transition junctions and that alternate between the first and second type of the first aesthetic characteristic.

Aspect 29: The method of any one of aspects 14-28, wherein at least the first yarn of the plurality of yarns comprises a third yarn section, wherein the engineered yarn structure comprises a second transition junction that comprises commingled portions of the second yarn section and the third yarn section, wherein the first aesthetic characteristic of the third yarn section is a third type that is different from the first and second types.

Aspect 30: The method of any one of aspects 14-29, wherein each of the first yarn section and the second yarn section of the first yarn has a respective length that is randomly generated during formation of the yarns.

Aspect 31: The method of any one of aspects 14-30, wherein the first and second yarn sections of the first yarn have respective lengths of between 800 meters and 5000 meters.

Aspect 32: The method of aspect 31, wherein the first and second yarn sections of the first yarn have respective lengths between 1000 meters and 3000 meters.

Aspect 33: The method of any one of aspects 14-32, wherein each yarn of the plurality of yarns comprises:

a first yarn section; and a second yarn section, wherein the engineered yarn structure comprises a transition junction that comprises commingled portions of the first yarn section and the second yarn section, wherein the transition junction has a length of less than 1 millimeter.

Aspect 34: A method comprising:

forming a yarn having an engineered yarn structure comprising:

a first yarn section; and a second yarn section, wherein the engineered yarn structure comprises a transition junction that comprises commingled portions of the first yarn section and the second yarn section, wherein the transition junction has a length of less than 1 millimeter, wherein the first section has a first type of a first aesthetic characteristic, and wherein the second section has a second type of the first aesthetic characteristic that is different from the first type.

Aspect 35: The method of aspect 34, wherein forming yarn comprises splicing a first yarn with a second yarn, wherein the first yarn has the first type of the first aesthetic, and wherein the second yarn has the second type of the first aesthetic.

Aspect 36: The method of aspect 35, wherein the first and second yarns are leftover yarns.

Aspect 37: The method of aspect 34, wherein forming the yarn comprises unitarily forming the yarn.

Aspect 38: The method of aspect 37, wherein unitarily forming the yarn comprises using a controller to apply a randomization algorithm to cause the first section of the yarn to have a random length of the first section.

Aspect 39: The method of aspect 38, wherein unitarily forming the yarn comprises using a controller to apply a randomization algorithm to cause the first section the yarn to have a random type of aesthetic characteristic.

Aspect 40: The method of any one of aspects 35-39, wherein the first aesthetic characteristic is color, wherein the first type is a first color, and wherein the second type is a second color.

Aspect 41: The method of any one of aspects 35-40, wherein the first aesthetic characteristic is luster, wherein the first type is a first luster, and wherein the second type is a second luster.

Aspect 42: The method of any one of aspects 34-41, further comprising winding the yarn around a bobbin to form a yarn package.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. An article comprising:

a backing; and a plurality of yarns tufted, woven, or knitted through the backing, each yarn defining at least one aesthetic characteristic, wherein the at least one aesthetic characteristic comprises one or more of luster, color, size, physical attribute associated with material type, or texture, wherein at least one yarn of the plurality of yarns comprises an engineered yarn structure having:

a first yarn section formed by a first yarn segment; and a second yarn section formed by a second yarn segment, wherein the engineered yarn structure comprises a transition junction that comprises commingled portions of the first yarn section and the second yarn section, wherein the transition junction has a length of less than 1 millimeter, wherein a severed end of the first yarn segment is wrap spliced, mechanically knotted, twisted, or entangled with a severed end of the second yarn segment to form the transition junction, and wherein the first section has a first type of a first aesthetic characteristic of the at least one aesthetic characteristic, and wherein the second section has a second type of the first aesthetic characteristic that is different from the first type.

2. The article of claim 1, wherein the first aesthetic characteristic is color, wherein the first type is a first color, and wherein the second type is a second color.

3. The article of claim 1, wherein the first aesthetic characteristic is luster, wherein the first type is a first luster, and wherein the second type is a second luster.

4. The article of claim 1, wherein the first aesthetic characteristic is uniform along each of the first yarn section and the second yarn section.

5. The article of claim 1, wherein the first yarn section of a first yarn of the at least one yarn of the plurality of yarns has a first length, wherein the first yarn section of a second yarn of the at least one yarn of the plurality of yarns has a second length that is different from the first length.

6. The article of claim 5, wherein the article has a first axis along which rows of tufts of the first and second yarns extend, wherein the first section of each of the first and second yarns has a respective starting location along the first axis, and wherein the starting location of the first section of the first yarn is axially offset from the starting location of the first section of the second yarn along the first axis.

7. The article of claim 1, wherein a first yarn of the at least one yarn of the plurality of yarns comprises a third yarn section, wherein the engineered yarn structure comprises a second transition junction that comprises commingled portions of the second yarn section and the third yarn section, wherein the first and third yarn sections of the first yarn both have the first type of the first aesthetic characteristic.

8. The article of claim 1, wherein at least a first yarn of the at least one yarn of the plurality of yarns comprises sequential yarn sections that are joined at respective transition junctions and that alternate between the first and second type of the first aesthetic characteristic.

9. The article of claim 1, wherein at least a first yarn of the at least one yarn of the plurality of yarns comprises a third yarn section formed by a third yarn segment, wherein the engineered yarn structure comprises a second transition junction that comprises commingled portions of the second yarn section and the third yarn section, wherein a second severed end of the second yarn segment is wrap spliced, mechanically knotted, twisted, or entangled with a severed end of the third yarn segment to form the second transition junction, wherein the first aesthetic characteristic of the third yarn section is a third type that is different from the first and second types.

10. The article of claim 1, wherein each of the first yarn section and the second yarn section of each yarn of the at least one yarn of the plurality of yarns has a respective length that is randomly generated during formation of the yarns.

11. The article of claim 1, wherein the first and second yarn sections of each yarn of the at least one yarn of the plurality of yarns have respective lengths of between 800 meters and 5000 meters.

12. The article of claim 11, wherein the first and second yarn sections of each yarn of the at least one yarn of the plurality of yarns have respective lengths between 1000 meters and 3000 meters.

13. A method comprising:

tufting, knitting, or weaving a plurality of yarns through a backing, wherein a first yarn of the plurality of yarns comprises an engineered yarn structure having:

a first yarn section formed by a first yarn segment; and a second yarn section formed by a second yarn segment, wherein the engineered yarn structure comprises a transition junction that comprises commingled portions of the first yarn section and the second yarn section, wherein the transition junction has a length of less than 1 millimeter, wherein a severed end of the first yarn segment is wrap spliced, mechanically knotted, twisted, or entangled with a severed end of the second yarn segment to form the transition junction, wherein the first yarn section has a first type of a first aesthetic characteristic selected from luster, color, size, or texture, and wherein the second yarn section has a second type of the first aesthetic characteristic that is different from the first type.

14. The method of claim 13, wherein the transition junction is formed by air splicing.

15. The method of claim 13, further comprising drawing the plurality of yarns from respective yarn packages, wherein a first yarn package of the respective yarn packages comprises the first yarn.

16. The method of claim 15, further comprising forming the plurality of yarns.

17. The method of claim 13, wherein a second yarn of the plurality of yarns comprises an engineered yarn structure having:

a first yarn section; and a second yarn section, wherein the engineered yarn structure comprises a transition junction that comprises commingled portions of the first yarn section and the second yarn section, wherein tufting, knitting, or weaving the plurality of yarns through the backing comprises moving the backing along a first axis and tufting the plurality of yarns through the backing to form a plurality of rows that extend along the first axis, wherein the first yarn section of each of the first and second yarns has a respective starting location along the first axis, and wherein tufting, knitting, or weaving the plurality of yarns through the backing comprises tufting, knitting, or weaving the starting location of the first yarn section of the first yarn in a location that is axially offset from the starting location of the first yarn section of the second yarn along the first axis.

18. A method comprising:

forming a yarn having an engineered yarn structure comprising:

a first yarn section formed by a first yarn segment; and a second yarn section formed by a second yarn segment, wherein the engineered yarn structure comprises a transition junction that comprises commingled portions of the first yarn section and the second yarn section, wherein the transition junction has a length of less than 1 millimeter, wherein the first section has a first type of a first aesthetic characteristic, and wherein the second section has a second type of the first aesthetic characteristic that is different from the first type, wherein forming the yarn comprises wrap splicing, mechanical knotting, twisting, or entangling respective adjacent severed ends of the first and second yarn segments to form the transition junction.

19. The method of claim 18, wherein the transition junction is formed by air splicing.

* * * * *